United States Patent [19]

Yuasa

[11] 4,456,365

[45] Jun. 26, 1984

[54] CHARGING DEVICE

[75] Inventor: Kazuhiro Yuasa, Zama, Japan

[73] Assignee: Ricoh Company, Ltd., Japan

[21] Appl. No.: 405,768

[22] Filed: Aug. 6, 1982

[30] Foreign Application Priority Data

Aug. 7, 1981 [JP] Japan ..... 56-123833

[51] Int. Cl.[3] ..... G03G 15/02

[52] U.S. Cl. ..... 355/3 CH; 250/326; 361/225

[58] Field of Search ..... 355/3 CH, 3 R; 250/324–326; 361/225; 355/14 CH

[56] References Cited

U.S. PATENT DOCUMENTS

| | | | |
|---|---|---|---|
| 3,961,193 | 6/1976 | Hudson | 250/325 X |
| 4,042,874 | 8/1977 | Quinn et al. | 361/225 X |
| 4,141,648 | 2/1979 | Gaitten et al. | 355/3 CH |
| 4,234,249 | 11/1980 | Weikel et al. | 355/14 CH |
| 4,268,161 | 5/1981 | Nakahata | 355/3 CH |
| 4,335,420 | 6/1982 | Mitsuo | 355/3 CH |
| 4,353,970 | 10/1982 | Dryczynski et al. | 361/225 X |

*Primary Examiner*—R. L. Moses

*Attorney, Agent, or Firm*—Guy W. Shoup

[57] ABSTRACT

An improved corona charging device for uniformly charging an image bearing or forming member is provided. The charging device includes a corona wire, a conductive shield partly surrounding the wire and a high voltage source connected to the wire. The voltage source includes a first voltage source for applying an A.C. voltage to the wire and a second voltage source for applying a D.C. voltage to the wire as a bias. The present charging device charges the member uniformly to a desired level at all times irrespective of the potential condition of the member prior thereto.

7 Claims, 6 Drawing Figures

CHARGING DEVICE

BACKGROUND OF THE INVENTION

1. Field of the Invention

This invention relates to transfer type image forming technology and in particular to a charging device for uniformly charging an image forming member as the first step of an image forming process.

2. Description of the Prior Art

A corona charging device for charging an image forming member which includes a photoconductive layer or a dielectric layer for forming an image thereon is well known in the art. For example, in a transfer type electrophotographic or electrostatic image forming system, an image forming member including a photoconductive or dielectric layer for forming an image thereon is first charged uniformly to a desired polarity by means of a D.C. corona charging device, and then the charges thus deposited on the image forming member are selectively dissipated in accordance with an image information to form an electrostatic latent image. Then toner is applied to the image forming member to convert the latent image into a visible toner image, which is then transferred to a transfer medium such as recording paper. On the other hand, after transfer, the image forming member is subjected to discharging and cleaning steps thereby removing residual charges and toner particles to provide the image forming member ready for the next cycle of image forming operation.

When uniform charging of the image forming member is to be carried out by a D.C. corona charging device, typically a scorotron charger, in the above-described image forming process, it is difficult to charge the image forming member to the saturation level primarily because of a relatively short period of time for charging. This is particularly true for the image forming member including a conductive support and a dielectric layer overlying the conductive support. As a result, the level of the surface potential of the image forming member after uniform charging varies from one cycle of operation to another in a repetitive operation. This is disadvantageous because resultant images are not uniform. Thus, in order to maintain the resultant images uniform in quality, it is necessary to control the bias voltage applied at the time of formation of a latent image and/or developing the latent image optimally, which is also disadvantageous since such a control operation is difficult to carry out. Under such circumstances, if use is made of corona transfer technology, the surface potential of the image forming member is affected additionally thereby making it still more difficult to maintain the surface potential of the image forming member substantially at the same level each time after uniform charging.

FIG. 1 shows the charging characteristics of a scorotron charger with the grid voltage $V_g$ as a parameter. The abscissa is taken for the discharging time in seconds and the ordinate is taken for the potential of the image forming member in volts. The characteristics shown in FIG. 1 are for the case in which the corona voltage is equal to 8,100 V and the onset voltage is equal to 4,100 V. As shown in FIG. 1, the rising time for the image forming member to reach the saturation level is relatively long; for that matter, the time constant in charging is rather large. For this reason, in order to carry out uniform charging at a high speed, which is usually required in a high speed image forming operation, the discharging step for removing residual charges from the image forming member is required prior to the step of uniform charging. In the case of absence of such a discharging step in the prior art, the surface potential of the image forming member tends to vary from one cycle of operation from another as shown in FIG. 2. As shown, the level of the surface potential differs in each cycle, $T_1$, $T_2$ and $T_3$ of operation, and, in some cases, it gradually increases in the positive direction as shown by the solid line, or in some cases, it gradually increases in the negative direction as shown by the dotted line. In FIG. 2, $T_s$ corresponds to a charging period by a scorotron charger; $T_r$ to a recording and developing period; and $T_t$ to a transferring period in one cycle of operation.

In the case where the image forming member includes a photoconductive layer, the image forming member may be discharged relatively easily and the surface potential may be set to 0 level by irradiation with uniform light; however, depending upon the material of the photoconductive layer, the service life of the image forming member could be significantly reduced due to such irradiation with uniform light. On the other hand, in the case where the image forming member includes a dielectric layer, it cannot be discharged by irradiation with uniform light, so that discharging in this case is usually carried out by A.C. corona discharge. In this case, however, it is rather difficult to set the surface potential at zero level by A.C. corona discharge, and, therefore, the gradual change in surface potential can only be slightly reduced as compared with the case shown in FIG. 2.

SUMMARY OF THE INVENTION

The disadvantages of the prior art are overcome with the present invention and an improved charging device for charging an image forming member to be used in a transfer type image forming process is provided. That is, the present charging device can set the surface potential of the image forming member at a predetermined level at all times irrespective of the potential condition of the image forming member prior thereto. Accordingly, when the image forming member is to be used repetitively, no discharging step to remove residual charges on the surface of the member is required if the present device is used for charging the image forming member uniformly as the first step in image forming operation.

The present corona charging device is to be advantageously used in a transfer type image forming process in which an image forming member is first uniformly charged and then the charges are selectively dissipated in accordance with an image to be formed to form an electrostatic latent image on the member. This is characterized by the fact that the corona wire is so structured to receive an A.C. voltage and a D.C. bias voltage superposingly. That is, in accordance with the characteristic feature of the present invention, there is provided a charging device for charging the surface of an image bearing or forming member uniformly prior to the formation of an electrostatic latent emage thereon while said charging device and said image forming member are being moved relative to each other, said device comprising at least one first corona wire extending across said image forming member in the direction transverse to the direction of the relative motion between said charging device and said image forming member; a first conductive shield surrounding said first corona wire, said shield being connected to a reference potential and defining an opening opened toward the surface of said image forming member; and a voltage source connected to said corona wire for applying a required voltage to said first corona wire to produce corona ions, said voltage source including a first voltage source for applying an A.C. voltage to said corona wire and a second voltage source for applying a D.C. voltage to said corona wire as a bias.

It is therefore a general object of the present invention to provide an improved corona charging device capable of charging the surface of an image bearing or forming member uniformly to a predetermined level at all times irrespective of the surface potential condition of the member prior thereto.

Another object of the present invention is to provide a charging device which may be advantageously used in the transfer type image forming process in which an image forming member on which an image is produced is repetitively used.

A further object of the present invention is to provide a charging device which eliminates the discharging step in repetitive image forming operation.

A still further object of the present invention is to provide a charging device simple in structure and thus easy to manufacture.

Other objects, advantages and novel features of the present invention will become apparent from the following detailed description of the invention when considered in conjunction with the accompanying drawings.

DESCRIPTION OF THE PREFFERRED EMBODIMENTS

Figure 1:
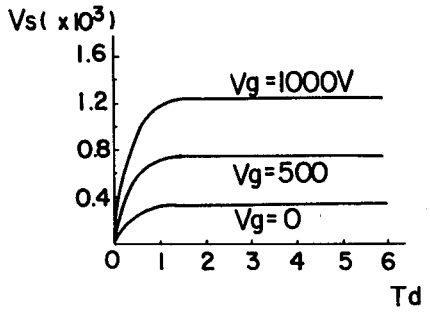
FIG. 1 is a graph illustrating charging characteristics of a typical scorotron charger with the grid potential as a parameter.
Figure 2:
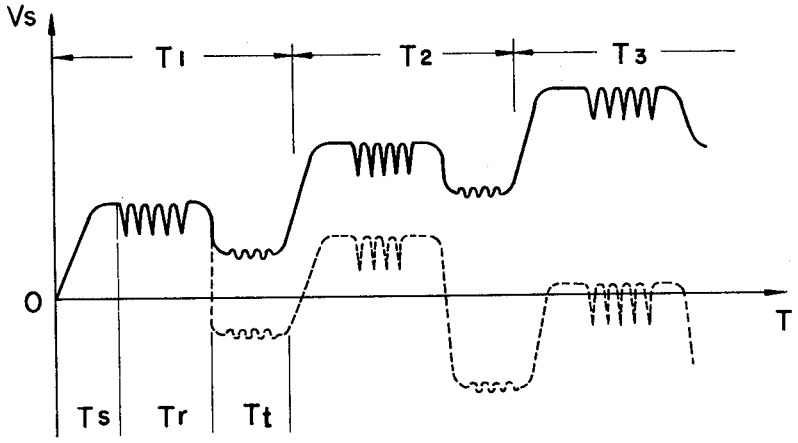
FIG. 2 is a graph illustrating the variation of the surface potential of a image forming member with respect to time when uniform charging is carried out solely by a scorotron charger.
Figure 3:
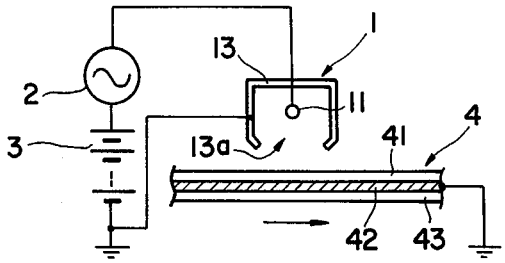
FIGS. 3–5 are schematic illustrations showing different embodiments of the present charging device.

Referring now to FIG. 3, there is shown a first embodiment of the present charging device 1 which comprises a corona wire 11 having a predetermined diameter and extending in the direction perpendicular to the plane of the drawings. The charger 1 also includes a conductive shield 13 which surrounds the wire 11 and defines an opening 13*a* directed toward the surface of an image bearing or forming member 4, which is moved to the right as indicated by the arrow with respect to the stationary charger 1. Thus, the corona ions produced in the space defined by the shield 13 are directed toward the surface of the member 4. Furthermore, an A.C. voltage source and a D.C. voltage source are connected in series between the corona wire 11 and ground. It is to be noted that the shield 13 is also connected to ground. The image forming member 4 includes a recording layer 41, which is comprised of a photoconductive or dielectric material, an electrically conductive layer 42 and a base support 43. As shown, the conductive layer 42 is connected to ground and thus the electric field formed between the corona wire 11 and the layer 42 will direct a part of the corona ions produced to move toward the surface of the member 4 thereby the member 4 becomes charged. It should be noted that the member 4 shown in FIG. 3 constitutes a part of a drum or an endless belt.

When the charger is structured as described above, a D.C. voltage is applied as a bias superposingly with an A.C. voltage to the corona wire 11 so that any charges remaining on the surface of the member 4 after transfer are completely removed mainly by the function of A.C. corona discharging characteristics and at the same time the surface potential of the member 4 may be properly set at a desired level due to the function of D.C. corona discharging characteristics. Therefore the member 4 can be presented for the uniform charging step of the next cycle of operation without subjecting the member 4 to a discharging step. This will contribute to facilitate the structure of the overall image processing apparatus and to speed up the image processing operation.

Figure 4:
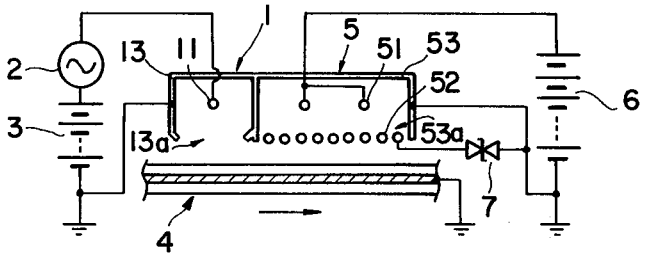

FIG. 4 shows a second embodiment of the present charging device in which a scorotron charger 5 is provided adjacent to and integrally with the A.C./D.C. biased charger 1. The scorotron charger 5 includes a pair of side-by-side corona wires 51 and an electrically conductive shield 53 which surrounds the wires 51 excepting an opening 53*a* opened toward the surface of the member 4. The shield 53 is integral with the shield 13, though this point is not essential to the present invention. The scorotron charger 5 is also provided with a screen grid 52 fixedly disposed at the opening 53*a* of the shield 53. As shown in FIG. 4, a D.C. voltage source 6 is connected between the corona wires 51 and ground and a varistor 7 is provided as connected between the grid 52 and ground. The varistor 7 functions to maintain the grid potential at a predetermined level so that the surface potential of the member 4 may be precisely set at a desired value.

Thus, by combining the scorotron charger 5 with the A.C./D.C. biased charger 1 and arranging such a combined charger with the scorotron charger 5 located in the downstream with respect to the direction of advancement of the image forming member 4, the surface of the member 4 is first discharged and at the same time charged roughly to the neighborhood of a desired level and then the surface is precisely set at a desired value due to the function of the scorotron charger 5. It is to be noted that a separate voltage source may be used in place of the varistor 7.

Figure 5:
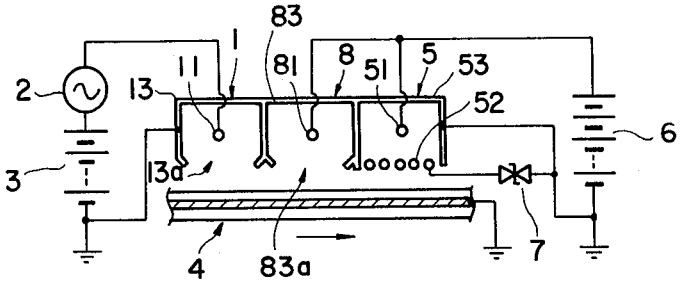

FIG. 5 shows a third embodiment of the present charger in which a corotron charger 8 is provided between the A.C./D.C. biased charger 1 and the scorotron charger 5. As shown, the corotron charger 8 includes a corona wire 81 which is connected to the high voltage end of the D.C. voltage source 6 and an electrically conductive shield 83 which surrounds the wire 81 and defines an opening 83*a* through which corona ions may be directed to the surface of the member 4. The A.C./D.C. charger section 1 corresponds to the structure shown in FIG. 3 and the scorotron charger section 5 virtually corresponds to the structure shown in FIG. 4 excepting that only a single corona wire 51 is provided in this embodiment. Such a combined structure is particularly useful if it is desired to set the surface potential of the member 4 at a higher level.

Figure 6:
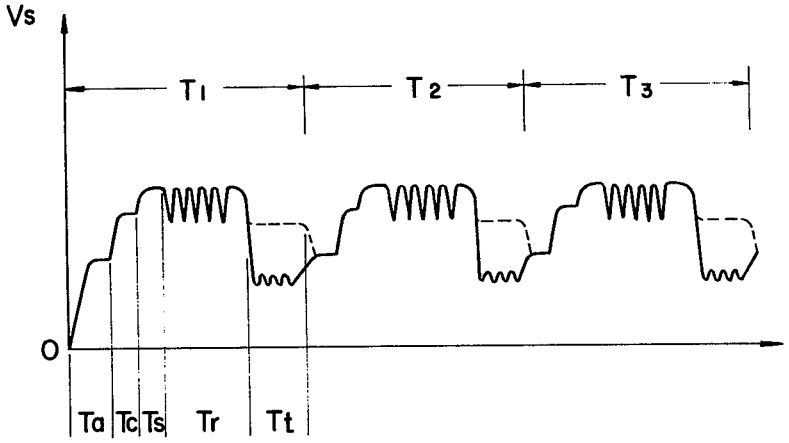
FIG. 6 is a graph illustrating the variation of the surface potential of an image forming member with respect to time when uniform charging is carried out by the charger shown in FIG. 5.

FIG. 6 illustrates how the surface potential of the member 4 varies when the member 4 is subjected to the image formation process repetitively with the use of the combined charger shown in FIG. 5. In FIG. 6, the abscissa is taken for time and the ordinate is taken for surface potential $V_s$ of the member 4. Each of the periods $T_1$, $T_2$ and $T_3$ represents the time period for completing one cycle of image forming operation. As shown, the surface potential of the member 4 is initially at 0, and when the combined charger shown in FIG. 5 is activated, the surface potential increases to a first level during period $T_a$ due to the charging by the A.C./D.C. charger section 1. Immediately thereafter, the surface potential is increased to a second level during period $T_c$ by means of the corotron section 8, and, then, the surface potential is further increased to a third level during period $T_s$ by means of the scorotron charger section 5. At this stage, the member 4 is uniformly charged to a desired level with high accuracy and thus image information may be applied to selectively dissipate the deposited charges to form an electrostatic latent image during the earlier part of period $T_r$. It is to be noted that any method well known to those skilled in the art may be applied in such application of image information. For example, in the case where the member 4 includes a photoconductive layer, a light image may be exposed to the member 4. On the other hand, a multi-stylus head may also be used for this purpose. In the later part of period $T_r$, the latent image is developed, typically by supplying toner to the latent image, to form a visible toner image. Then the toner image is transferred to a transfer medium such as recording paper during period $T_t$. During the transfer period, charges of the polarity opposite to that of the toner are applied to the back side of the transfer medium, so that the surface potential of the member 4 fluctuates as shown in FIG. 6. In some cases, the surface potential drops below the first level as indicated by the solid line; and, in some cases, the surface potential stays at a relatively high level as indicated by the dotted line. Preferably, cleaning is carried out in the latter half of period $T_t$ to remove residual toner from the surface of the member 4.

Then, without carrying out a discharging step, the next following image forming sequence $T_2$ is immediately initiated so that, by the action of the A.C./D.C. charger section 1, the surface potential of the member 4 is brought to the first level during period $T_a$ of the next cycle $T_2$. Likewise, the similar operation as described above follows. In this manner, in accordance with the present invention, the image forming member 4 can be uniformly charged to a desired level with high accuracy at all times irrespective of the potential condition of the member 4 prior to uniform charging. Accordingly, images of the same quality may be obtained in successive imaging operations. No additional control is required at any other process steps.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A charging device for charging the surface of an image forming member uniformly prior to the formation of an electrostatic latent image thereon while said charging device and said image forming member are being moved relative to each other, said device comprising:

at least one first corona wire extending across said image forming member in the direction transverse to the direction of the relative motion between said charging device and said image forming member;

a first conductive shield surrounding said first corona wire, said shield being connected to a reference potential and defining an opening opened toward the surface of said image forming member;

a voltage source connected to said corona wire for applying a required voltage to said first corona wire to produce corona ions, said voltage source including a first voltage source for applying an A.C. voltage to said corona wire and a second voltage source for applying a D.C. voltage to said corona wire as a bias;

at least one second corona wire extending generally in parallel with said first corona wire disposed outside the space defined by said first shield;

a second conductive shield surrounding said second corona wire, said second shield being connected to said reference potential and defining a second opening opened toward the surface of said image forming member; and a third voltage source connected to said second corona wire for applying a predetermined D.C. voltage to said second corona wire.

2. The device of claim 1 wherein said second corona wire is located in the downstream of said first corona wire with respect to the relative motion between said charging device and said image forming member.

3. The device of claim 2 wherein said first and second conductive shields are integrally formed.

4. The device of claim 1 further comprising:

a conductive screen grid fixedly provided in said opening of said second shield; and means for maintaining the grid potential at a predetermined level.

5. The device of claim 4 wherein said grid potential maintaining means includes a varistor connected between said grid and said reference potential.

6. The device of claim 4 further comprising:

at least one third corona wire extending generally in parallel with and sandwiched between said first and second corona wires, said third corona wire being disposed outside the spaces defined by said first and second shields and connected to said third voltage source; and a third conductive shield surrounding said third corona wire, said third shield being connected to said reference potential and defining a third opening opened toward the surface of said image forming member.

7. The device of claim 6 wherein said first, second and third conductive shields are integrally formed.

* * * * *